United States Patent [19]

Hiraoka

[11] 4,360,331

[45] Nov. 23, 1982

[54] APPARATUS FOR MOLDING A CONCRETE PIPE

[75] Inventor: Kunizo Hiraoka, Tokyo, Japan

[73] Assignee: Hiraoka Giken Kogyo Co., Ltd., Saitama, Japan

[21] Appl. No.: 262,028

[22] Filed: May 8, 1981

Related U.S. Application Data

[62] Division of Ser. No. 159,923, Jun. 16, 1980, Pat. No. 4,311,632.

[51] Int. Cl.[3] ..... B28B 21/24

[52] U.S. Cl. ..... 425/145; 425/147; 425/148

[58] Field of Search ..... 264/40.4, 40.5, 270; 425/140, 149, 145, 147, 148

[56] References Cited

U.S. PATENT DOCUMENTS

| | | | |
|---|---|---|---|
| 3,649,727 | 3/1972 | Gauger | 264/40.5 |
| 3,706,516 | 12/1972 | Kisteneich | 425/145 |
| 3,788,916 | 1/1974 | Gadelius | 264/270 |
| 3,891,368 | 6/1975 | Hart | 425/147 |
| 4,038,001 | 7/1977 | Stinnes | 264/270 |

FOREIGN PATENT DOCUMENTS

| | | | |
|---|---|---|---|
| 153198 | 4/1963 | U.S.S.R. | 264/40.5 |

*Primary Examiner*—James H. Derrington
*Attorney, Agent, or Firm*—Wenderoth, Lind & Ponack

[57] ABSTRACT

An apparatus for molding a concrete pipe in which a belt conveyor runs parallel to the axis of a molding flask and is adapted to longitudinally move in the molding flask within the range between both ends of the molding flask. The belt conveyor is subjected to intermittent longitudinal movement at a fixed traveling distance in response to a prescribed degree of compactedness of concrete attained in each position where the belt conveyor stops.

3 Claims, 3 Drawing Figures

APPARATUS FOR MOLDING A CONCRETE PIPE

This is a division of application Ser. No. 159,923, filed June 16, 1980, now U.S. Pat. No. 4,311,632.

The present invention relates to a process and an apparatus for molding a concrete pipe, and more particularly to a process and an apparatus for molding a concrete pipe in which stiff-consistency concrete is fed to a molding flask and pressed with a pressing roller.

It has been a common practice that most of the concrete required for molding a Hume concrete pipe is spread on the whole of the internal periphery of a molding flask in the first stage of the feed of concrete to the molding flask, and then the remaining concrete is distributed at intervals between both ends of the molding flask in the second stage.

It has also been a common practice to feed a rotary molding flask with fluid concrete in which the percentage of water content is 40% or more and mold this fluid concrete into a pipe either by centrifugal force alone or by the cooperative action of centrifugal force and pressing roller.

With the conventional practice, however, it is extremely difficult to supply a proper quantity of concrete to a proper part of the internal periphery of the molding flask so that the whole of the internal periphery of the molding flask may be evenly supplied with concrete. Thus, poor strength of the pipe is often caused by uneven wall thickness.

Another disadvantage of the conventional practice is that 6 to 8 hours are required for solidifying the fluid concrete and allowing it to be released from the molding flask.

Still another disadvantage of the conventional practice is that a portion of the fluid concrete with which the molding flask is fed is apt to be spilt. It is necessary, therefore, to wash off the spilt concrete with a comparatively large quantity of water. The quantity of water required for washing off the spilt concrete amounts to 50 to 70 tons in case where a factory turns out 200 tons of Hume concrete pipes daily. The trouble is that the water used in washing off the spilt concrete cannot be drained until hexatomic chromium contained in the spilt concrete is removed from the water in accordance with the provisions of the law concerning the prevention of environmental pollution.

It is an object of the present invention to provide a process and an apparatus for molding a concrete pipe which obviate the above-described disadvantages.

It is another object of the present invention to provide a process and an apparatus for molding a concrete pipe in which the degree of compactedness of concrete is detected in each place during the distribution of the concrete at intervals between both ends of the molding flask in the second stage of the feed of concrete to the molding flask.

It is still another object of the present invention to provide a process and an apparatus for molding a concrete pipe in which, when the prescribed degree of compactedness of concrete is attained in one place during the distribution of the concrete at intervals between both ends of the molding flask in the second stage of the feed of concrete to the molding flask, the belt conveyor for carrying fresh concrete is moved to the next place and operation is repeated in each place until the full length of the molding flask is covered by the second-stage feed of concrete.

It is yet still another object of the present invention to provide a process and an apparatus for molding a concrete pipe in which the concrete is solidified in a short time in the molding flask and can be released therefrom soon after the feed of concrete thereto.

It is a further object of the present invention to provide a process and an apparatus for molding a concrete pipe in which the consistency of concrete to be fed to a molding flask is so high that the concrete is unlikely to be spilt.

With these objects in view and as will become apparent from the following detailed description, the present invention will be more clearly understood in connection with the accompanying drawings, in which.

Figure 1:
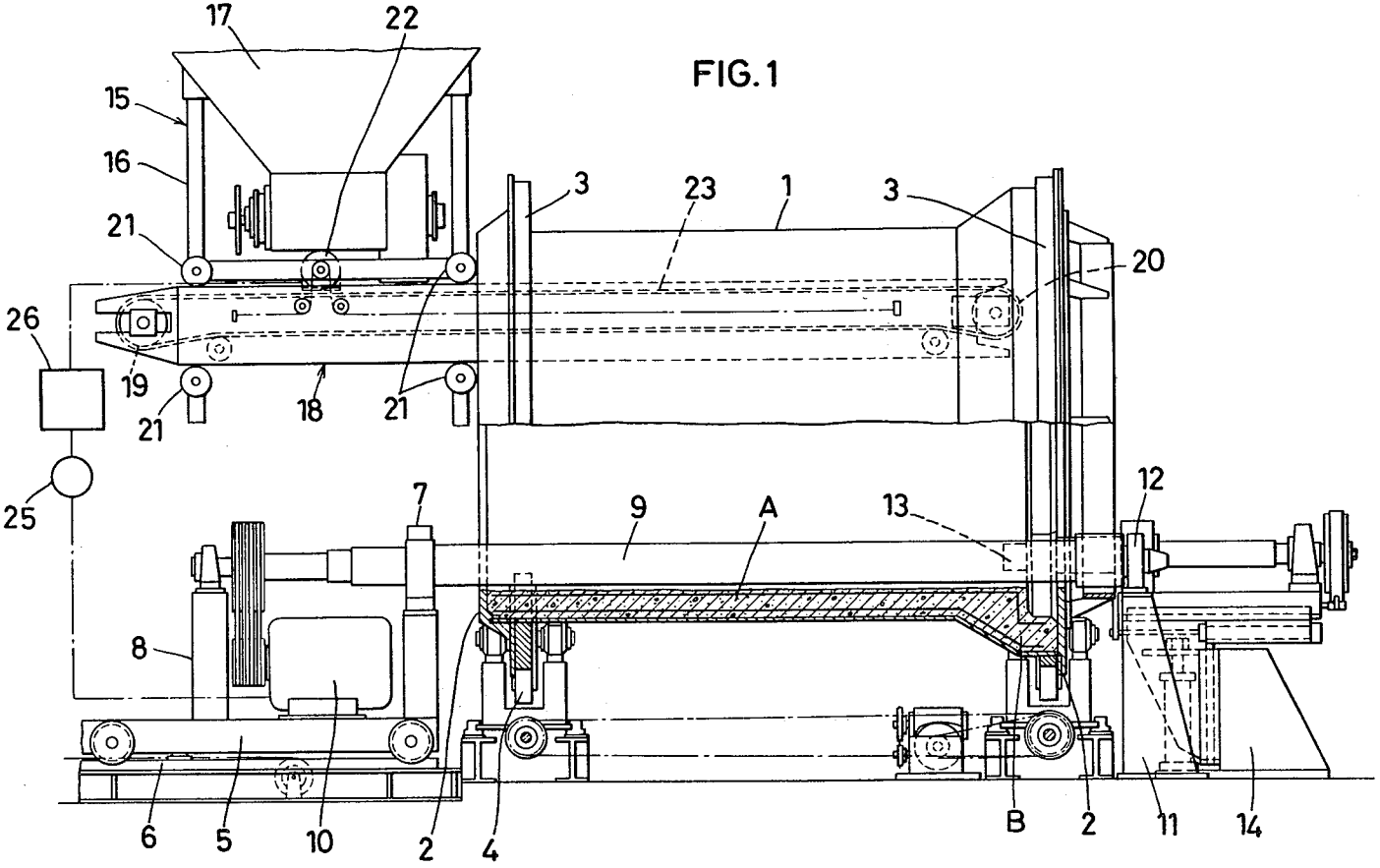
FIG. 1 is a partially cutaway front view of the first embodiment of the present invention.

Referring now to FIG. 1, an apparatus in accordance with the present invention includes a cylindrical molding flask 1 which has its axis in a horizontal position and in which a concrete pipe A is to be formed. Both ends of the molding flask 1 are provided with annular end plates 2, by which the end surfaces of the concrete pipe A are formed.

Wheels 3 provided on both ends of the molding flask 1 are supported by rollers 4. When the rollers 4 are driven by a motor (not shown), they impart rotary motion to the wheels 3 so that the molding flask 1 may be rotated on its own axis. The space between the rollers 4 is adjustable so that molding flasks of different lengths can be supported.

A truck 5 is adapted to run on rails 6 which are laid on one side of the molding flask 1 in parallel with the axis of the molding flask 1. Supporting frames 7 and 8, which are built as a vertical extension of the chassis of the truck 5, rotatably support one end of a pressing roller 9. The axis of the pressing roller 9 runs parallel to the axis of the molding flask 1 so that, when the truck 5 approaches the molding flask 1, the pressing roller 9 gets into the molding flask 1. Movement of the pressing roller 9 toward the other side of the molding flask 1 is limited by a bearing 12 mounted on a pedestal 11. Namely, a journal provided on the tip of the pressing roller 9 fits into the bearing 12 when the pressing roller 9 reaches the limit of its rightward movement in FIG. 1.

The pressing roller 9 is rotated by a motor 10 mounted on the truck 5.

Another pressing roller 13 allotted for forming the internal surface of the bell end B of the concrete pipe A is mounted on a pedestal 14. The pedestals 11 and 14 are on the same side of the molding flask 1. The pressing roller 13 is adapted to move up and down and axially get into and retreat from the molding flask 1.

A means for supplying the molding flask 1 with fresh concrete, which is generally designated by the numeral 15, is provided on the truck side, i.e. left side in FIG. 1, of the molding flask 1. The means 15 includes a frame 16 erected on the floor, a hopper 17 supported by the frame 16, and a belt conveyor 18 extending horizontally under the hopper 17 so as to run parallel to the axis of the molding flask 1. The delivery port of the hopper 17 is provided with a means for delivering fresh concrete at a fixed flow rate. The belt conveyor 18 includes a motor-driven conveyor belt 23 which operates over terminal pulleys 19 and 20.

Rollers 21 mounted on the frame 16 support the belt conveyor 18 in such a manner that the belt conveyor 18 is allowed to longitudinally move.

A motor 22 mounted on the frame 16 supplies the belt conveyor 18 with motive power so that the right-hand end of the belt conveyor 18 may be moved within the range between both ends of the molding flask 1 in the axial direction thereof.

In operation, the truck 5 is allowed to advance toward the molding flask 1 so that the pressing roller 9 may be allowed to get into the molding flask 1 to such an extent that the journal provided on the tip of the pressing roller 9 fits into the bearing 12. The pressing roller 13 is also allowed to get into the molding flask 1.

Then the motor 22 is started, and the belt conveyor 18 advances into the molding flask 1.

Then the molding flask 1, motor 10 and conveyor belt 23 are started. Fresh concrete is delivered from the hopper 17, placed on the conveyor belt 23, carried to the right-hand end of the belt conveyor 18, and fall thereover. Most of the concrete required for molding a concrete pipe is spread on the whole of the internal periphery of the molding flask 1 in the first stage of the feed of concrete to the molding flask 1, and then the remaining concrete is distributed at intervals between both ends of the molding flask 1 in the second stage.

In order to make the inner wall of the concrete pipe smooth in the first stage of the feed of concrete to the molding flask 1, it is desirable that the peripheral velocity of the pressing roller 9 should be at least 1.1 times as high as the speed of revolution of the concrete pipe measured on the inner wall thereof.

The second stage of the feed of concrete to the molding flask 1 begins with the belt conveyor 18 placed in the position shown in FIG. 1. An increase in the degree of compactedness of concrete causes an increase in the resistance of concrete to the revolution of the pressing roller 9, which in turn causes an increase in the power consumption of the motor 10, hence an increase in the intensity of the electric current flowing through the power circuit for the motor 10. When the increase in the current intensity reaches a certain level, an ammeter 25 provided in the power circuit for the motor 10 gives a signal to a controller 26 so as to allow the latter to actuate the motor 22. Then the motor 22 operates, and stops when the prescribed number of revolutions is attained. The belt conveyor 18 is thereby moved to the next position on the left side. The above-mentioned operation is repeated in each position until the full length of the molding flask 1 is covered by the second-stage feed of concrete.

Figure 2:
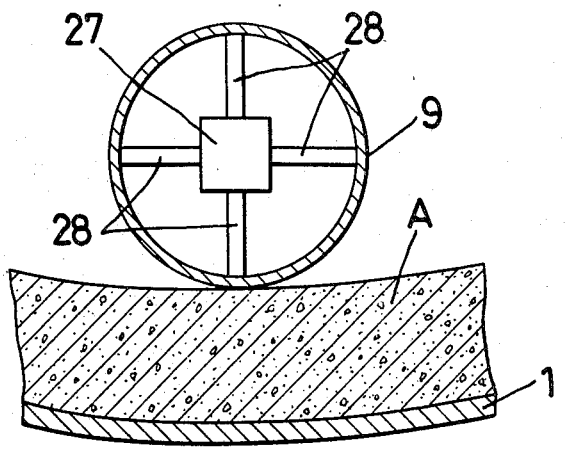
FIG. 2 is a sectional side elevation of a part of the second embodiment of the present invention.
Figure 3:
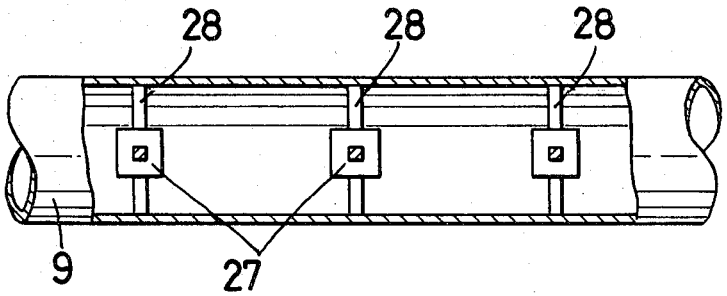
FIG. 3 is a partially cutaway front view of a part of the pressing roller used in the second embodiment of the present invention.

The second embodiment of the present invention shown in FIGS. 2 and 3 is suited for molding a concrete pipe having a comparatively large diameter. In this case, a plurality of strain meters 27 are accommodated in the pressing roller 9. Each strain meter 27 is supported by four radiating bars 28 so that the strain meters 27 may be in alignment with the axis of the pressing roller 9. The positions in which the strain meters 27 are arranged correspond to the positions in which the right-hand end of the belt conveyor 18 is stopped in regular succession in the second stage of the feed of concrete to the molding flask 1.

In case of this second embodiment, an increase in the degree of compactedness of concrete on the internal periphery of the molding flask 1 in the second stage of the feed of concrete to the molding flask 1 causes minute deformation of the pressing roller 9, which is detected by a strain meter 27 and converted into change in electric resistance. Then the strain meter 27 gives a signal to the controller 26 so as to allow the latter to actuate the motor 22 for the intermittent movement of the belt conveyor 18. The present invention has an advantage that the concrete can be evenly compacted throughout the full length of the molding flask 1. Consequently, under the condition that iron meshworks of the same shape are embedded in the concrete, the strength of a concrete pipe molded in accordance with the present invention is approximately twice as much as that of a Hume concrete pipe molded by the conventional method. The concrete pipes molded in accordance with the present invention, therefore, can be used in the places where they have to undergo heavy load. In the alternative, light pipes which are easy to handle and handy to carry can be manufactured by reducing the wall thickness.

The present invention has another advantage that the concrete is solidified in a short time in the molding flask 1 and can be released therefrom 30 to 90 minutes after the feed of concrete thereto. This advantage is derived from the fact that, in either embodiment of the present invention, the molding flask 1 is supplied with stiff-consistency concrete in which the percentage of water content is 22% to 30%. If concrete in which the percentage of water content is less than 28% is used, the length of time required for the solidification of concrete will be reduced to 30 minutes.

The reduction of the length of time required for the solidification of concrete has two effects. First, the capacity of the process for manufacturing concrete pipes is remarkably increased. Secondly, the number of molding flasks can be reduced to 20% or less and, therefore, the process and apparatus in accordance with the present invention are space-saving.

The present invention has still another advantage that the consistency of concrete to be fed to the molding flask 1 is so high that the concrete is unlikely to be spilt. This advantage is accompanied by two consequences. First, the quantity of cement to be used as an ingredient of concrete can be curtailed by approximately 20% as compared with the conventional method. Secondly, water for washing off the spilt concrete can be dispensed with, hence a waste water disposal plant for removing hexatomic chromium from the water can also be dispensed with.

While two embodiments of the present invention have been disclosed, it is to be understood that they have been described by way of example only, various other modifications being obvious.

What I claim is:

1. An apparatus for molding a concrete pipe comprising a cylindrical molding flask having its axis in a horizontal position and adapted to rotate on its own axis, a pressing roller running parallel to the axis of said molding flask and adapted to axially get into and retreat from said molding flask, a motor for rotating said pressing roller, a power circuit for said motor, a belt conveyor running parallel to the axis of said molding flask and adapted to longitudinally move in said molding flask within the range between both ends of said molding flask, means for delivering fresh concrete at a fixed flow rate to said belt conveyor, and means for causing intermittent longitudinal movement of said belt conveyor at a fixed traveling distance in response to a prescribed degree of compactedness of concrete attained in each position where said belt conveyor stops.

2. An apparatus as set forth in claim 1, wherein said means for causing intermittent longitudinal movement of said belt conveyor comprises an ammeter provided in the power circuit for said motor for rotating said pressing roller and a controller adapted to actuate said means for causing intermittent longitudinal movement of said belt conveyor in response to a signal given by said ammeter when a prescribed degree of compactedness of concrete is attained in each position where said belt conveyor stops.

3. An apparatus as set forth in claim 1, wherein said means for causing intermittent longitudinal movement of said belt conveyor comprises a plurality of strain meters accommodated in said pressing roller and supported by radiating bars so that said strain meters may be in alignment with the axis of said pressing roller and a controller adapted to actuate said means for causing intermittent longitudinal movement of said belt conveyor in response to a signal given by one of said strain meters when minute deformation of said pressing roller is detected by said one of said strain meters.

* * * * *